US005830321A

United States Patent [19]

Lindsay et al.

[11] Patent Number: 5,830,321

[45] Date of Patent: Nov. 3, 1998

[54] METHOD FOR IMPROVED RUSH TRANSFER TO PRODUCE HIGH BULK WITHOUT MACROFOLDS

[75] Inventors: Jeffrey Dean Lindsay; Fung-jou Chen, both of Appleton, Wis.

[73] Assignee: Kimberly-Clark Worldwide, Inc., Neenah, Wis.

[21] Appl. No.: 790,980

[22] Filed: Jan. 29, 1997

[51] Int. Cl.[6] ..... D21F 11/00

[52] U.S. Cl. ..... 162/204; 162/205; 162/306; 162/210; 162/358.3; 162/361; 162/363; 34/117; 34/114; 226/97.3

[58] Field of Search ..... 162/204, 205, 162/206, 203, 202, 306, 358.3, 210, 361, 363; 34/114, 120, 122, 117; 226/973

[56] References Cited

U.S. PATENT DOCUMENTS

| | | | |
|---|---|---|---|
| 3,309,263 | 3/1967 | Grobe | 162/306 |
| 3,339,550 | 9/1967 | Van Haaften | 128/290 |
| 3,351,521 | 11/1967 | Murray et al. | 162/307 |
| 3,861,996 | 1/1975 | Dorfel | 162/274 |
| 4,072,557 | 2/1978 | Schiel | 162/111 |
| 4,102,737 | 7/1978 | Morton | 162/113 |
| 4,225,384 | 9/1980 | Valkama | 162/199 |
| 4,440,597 | 4/1984 | Wells et al. | 162/111 |
| 4,529,480 | 7/1985 | Trokhan | 162/109 |
| 4,551,199 | 11/1985 | Weldon | 162/109 |
| 4,849,054 | 7/1989 | Klowak | 162/109 |
| 4,942,077 | 7/1990 | Wendt et al. | 428/152 |
| 5,048,589 | 9/1991 | Cook et al. | 162/109 |
| 5,098,519 | 3/1992 | Ramasubramanian et al. | 162/109 |
| 5,325,608 | 7/1994 | Mayer | 34/114 |
| 5,411,636 | 5/1995 | Hermans et al. | 162/109 |
| 5,429,686 | 7/1995 | Chiu et al. | 139/383 A |
| 5,492,598 | 2/1996 | Hermans et al. | 162/113 |
| 5,609,728 | 3/1997 | Durden | 162/205 |
| 5,614,293 | 3/1997 | Krzsik et al. | 428/211 |
| 5,656,132 | 8/1997 | Farrington, Jr. et al. | 162/117 |
| 5,672,248 | 9/1997 | Wendt et al. | 162/109 |

FOREIGN PATENT DOCUMENTS

| | | | |
|---|---|---|---|
| 873651 | 6/1971 | Canada . | |
| 1029998 | 4/1978 | Canada . | |
| 1696176 B | 12/1971 | Germany . | |
| 2 105 091 | 5/1972 | Germany | D21F 2/06 |
| 9 110 134 | 11/1991 | Germany | D21F 5/00 |
| 1 212 473 | 11/1970 | United Kingdom . | |
| 2 279 372 | 1/1995 | United Kingdom . | |

OTHER PUBLICATIONS

Derwent World Patent Database abstract of DE 1,696,176 B: Description of Clupak Inc., "Longitudinal Compaction of Newsprint."

Derwent World Patent Database abstract of DE 2,112,395 A: Description of Oy A. Ahlstrom, "Paper Pick Up And Press Section."

*Primary Examiner*—Stanley S. Silverman
*Assistant Examiner*—Jose A. Fortuna
*Attorney, Agent, or Firm*—Gregory E. Croft

[57] ABSTRACT

A method for improving the rush transfer of a web, such as a tissue web, is disclosed. The method provides for greater angles of convergence and divergence of the carrier fabric and the transfer fabric at the point of transfer by deflecting the carrier fabric toward the transfer fabric using a deflection element, such as a roll, positioned opposite the vacuum transfer head. The greater angles of convergence and divergence minimize the potential for undesirable macrofolds being formed in the web during transfer.

30 Claims, 4 Drawing Sheets

METHOD FOR IMPROVED RUSH TRANSFER TO PRODUCE HIGH BULK WITHOUT MACROFOLDS

BACKGROUND

In the art of papermaking, many processes rely on wet forming, whereby a dilute aqueous slurry of papermaking fibers is deposited on a moving fabric or between two moving porous belts. The slurry is drained through the fabric or fabrics to create an embryonic web of wet fibers, which is then further processed in a variety of ways, optionally including operations such as pressing, wet molding, rush transfer, through drying, contact drying, creping, microcreping, coating, calendering, embossing, and the like to create a dry web of paper with desired properties. For many products such as towels, facial and bath tissue, absorbent components in absorbent articles, wipers, and the like, desired attributes may include any of the following: high bulk, high absorbency, high wet resiliency, high internal void volume, flexibility, and high stretch or extensibility under tension. One operation which can be useful in enhancing some of these properties is foreshortening of the web. Web foreshortening can achieve a variety of physical properties, depending on the mode of execution. One mode of execution is to transfer a web from a carrier fabric to a transfer fabric (either a drying fabric or an intermediate fabric or felt), with the transfer fabric traveling at a substantially slower speed than the carrier fabric. Such a method involving a differential velocity transfer to a slower fabric is termed rush transfer. The earliest known example of rush transfer is by G. W. Dorfel in Ger. Pat. No. 2,112,395, "Process and Apparatus for the Treatment of the Paper Web in a Paper Machine," Oct. 7, 1971, who teaches transferring of a web after one nip onto a felt running into a second nip of a press section with the second nip running more slowly than the first. This transfer process eliminates the stretching of the sheet that often occurs during a draw and is said to improve sheet stretch properties. Likewise, P. J. Valkama in U.S. Pat. No. 4,225,384, "Method of Operating a Paper Machine, Particularly a Press Section Thereof," issued Sep. 30, 1980, teaches a method of making stretchable paper or board that includes shortening the web according to Finnish patent 44,334.

An early example of rush transfer for tissue is taught by Christian Schiel in U.S. Pat. No. 4,072,557, "A Method and Apparatus for Shrinking a Traveling Web of Fibrous Material," issued Feb. 7, 1978. Schiel's method is presented as an alternative to dry creping for webs with insufficient strength for creping. The process gives higher MD tensile than if the web were foreshortened the same degree by creping. Rush transfer to a slower moving fabric occurs across a centrifugal force transfer head, applying a differential pneumatic pressure across the wires to move sheet to the new fabric. The goal is a shrunken web with high strength, not high bulk. Like the present invention, Schiel teaches a rush transfer configuration in which the carrier fabric is deflected upwards toward a transfer fabric. Schiel also teaches the use of a small radius of curvature (less than 5 inches) in the transfer head (herein termed the carrier fabric deflection element), teaches the use of a suction box above the transfer fabric, and teaches the use of air pressure delivered through a nozzle in the carrier fabric deflection element to apply differential pressure across the web to effect its transfer. Schiel's drawings show the transfer fabric traveling in a single plane, undeflected by impingement from the carrier fabric deflection element, but any force of contact between the two wires will result in deflection and the impingement of one wire into the other, reducing the angles of convergence and divergence and increasing the size of the contact zone.

Another method more suitable for soft tissue is that of E. Wells and T. A. Hensler in U.S. Pat. No. 4,440,597 "Wet-microcontacted Paper and Concomitant Process," issued Apr. 3, 1984. Wells and Hensler teach the use of a transfer fabric having higher void volume than the carrier fabric in order for the sheet to be forced into the additional void volume as it decelerates. A curved, convex transfer head with a central vacuum slot is used to force the two wires together and to transfer the web. In effect, the invention of Wells and Hensler is much the same as Schiel's except that the paper web in Schiel is transferred away from the wire in contact with the transfer head, while in Wells and Hensler it is transferred onto the wire in contact with the transfer head, with positive pressure from the transfer head needed for the transfer in Schiel, whereas vacuum pressure is required for the transfer in Wells and Hensler. The vacuum pickup shoe used in Wells and Hensler is related to that taught in commonly assigned U.S. Pat. No. 3,309,263 by R. E. Grobe, "Web Pickup and Transfer for a Papermaking Machine," issued Mar. 14, 1967. A related web transfer technology is the use of a suction roll for transfer of a web from a forming fabric without compression in a nip as found in Can. Pat. 873,651 issued to D. C. Cronin on Jun. 22, 1971.

Rush transfer in an uncreped process for making towels is taught by R. F. Cook and D. S. Westbrook in U.S. Pat. No. 5,048,589, "Non-creped Hand or Wiper Towel," issued Sep. 17, 1991, hereby incorporated by reference. The web is transferred from the forming fabric to a through drying fabric with a differential velocity less than about 10%. A related concept is taught by Bernard Klowak in U.S. Pat. No. 4,849,054, "High-bulk, Embossed Fiber Sheet Material and Apparatus and Method of Manufacturing the Same," issued Jul. 18, 1989. In Klowak's method, the web is pressed to a solids level of over 30% and transferred to a smooth roll, followed by rush transfer from the roll onto a highly textured three-dimensional fabric in order to emboss the sheet against the transfer fabric. In that case, there is relatively little microcompaction of the sheet during rush transfer (evidenced by the very high tensile strength of the web); the increased bulk is largely due to macroscopically conforming the sheet onto the textured fabric (external bulk). In contrast, rush transfer to a relatively planar, low-void volume transfer fabric can result in significant bulking of the sheet at a microscopic level (internal bulk) while maintaining a relatively smooth structure macroscopically. Such a method is taught by T. E. Farrington et al. in commonly assigned co-pending Great Britain application 2 279 372 A, "Soft Tissue Paper," published Jan. 4, 1995. In the method of Farrington et al., rush transfer preferably occurs between the forming fabric and a subsequent additional relatively smooth transfer fabric, from which the sheet will be transferred again onto a through drying fabric (also with optional rush transfer). This method is related to that taught by Steven A. Engel et al. in commonly assigned co-pending application Ser. No. 08/036,649 entitled "Method for Making Smooth Uncreped Throughdried Sheets" filed Mar. 24,1993. One or more transfer fabrics is positioned between the forming fabric and a subsequent through drying fabric. During the sheet transfer from the forming fabric to the transfer fabric or the transfer from the transfer fabric to the through drying fabric, or both, the transfer is from one fabric to a fabric moving at a substantially slower speed. Such a method can result in machine direction stretch (as determined with standard MD tensile strength testing of a conditioned sheet) of 5 to about 40 percent in an uncreped sheet.

An important aspect of the rush transfer method taught by Engel et al. is that the region of contact between the two wires moving at different velocities should be small. In experimental work, it was learned that the rush transfer shoe used in the method of Wells and Hensler significantly limits the success of the rush transfer process. Under many conditions, the product may be marred by "macrofolds," which appear to be regions where part of the sheet has buckled and has been folded back upon itself. Macrofolds are believed to be a potential problem in all known forms of rush transfer, but the severity of the problem or the conditions in which it is likely will be strongly determined by the nature of the rush transfer process. Wells and Hensler teach the use of a curved transfer shoe with constant radius of curvature which is depressed into the span of the carrier fabric, allowing a significant length of contact between the two fabrics, including contact before and after the vacuum slot. Under many otherwise desirable operating conditions, the prolonged span of the zone in which the sheet is transferring from one fabric to the other is believed to allow buckling of the sheet to occur, resulting in macrofolds. In contrast, Engel et al. teach the use of a transfer shoe wherein the carrier fabric and the transfer fabric converge and diverge at the leading edge of the vacuum slot (apparently based on the assumption that the fabrics are not deformed by the presence of vacuum and that the fabrics and the web have no thickness—but in reality the contact zone will be finite). By moving towards "point contact" between the two webs, Engel et al. provided a rush transfer system with much more flexibility in terms of successful operating conditions and one which better served to provide internal debonding and bulking of the sheet, rather than merely conforming a sheet to a fabric with high void volume. The use of a relatively smooth transfer fabric was especially helpful in achieving the objective of increased internal bulk and softness.

Other methods of sheet foreshortening are known, including dry microcreping, wet creping and dry creping, and methods involving transfer between a web on a solid roll to a slower-moving fabric. Such a method is taught for compacting newsprint for increased thickness in the German application DE 1696176 B, published Sep. 30, 1976, by H. S. Welsh. Welsh's invention involves a moving band in contact for a substantial distance with a faster moving roll, said roll entering the contact zone with a paper web attached to its surface. The velocity differential is said to increase the thickness of the web by 2–4%. The web is required to be at 30–50% dryness. A patent to S. B. Weldon, "Apparatus and process for treating web material," U.S. Pat. No. 4,551,199, issued Nov. 5, 1985, discloses a similar concept, in which a textured transfer fabric engages a web on a faster moving roll, allowing the web to be compressed into the void spaces of the fabric and thus become locked in place. The process is said to crepe, emboss, add bulk, and increase the stretch of the sheet so treated.

In addition to vacuum rolls and vacuum transfer heads for effecting transfer of a sheet from one web to another, air jets and air blowers are also known. M. M. Murray and B. H. Andrews in U.S. Pat. 3,351,521, "Transfer Mechanism for Web," issued Nov. 7, 1967, teach the use of an air jet to facilitate the transfer of a wet paper web to a felt. In this system, the air jet serves to loosen the web from being firmly attached to the forming fabric. The loosened paper web travels across a substantial open draw and bends around a roller before it is brought in proximity to the felt. The air jet does not place the wet web against the felt. The felt appears to be several feet away from the air jet and the vector defined by the flow from the air nozzle does not even intersect the felt. There is no mechanism to achieve rush transfer with this system.

L. B. Osterberg and B. A. Unneberg in Can. Pat. No. 1,029,998, "Arrangement for Separating a Paper Web From the Wire in a Papermaking Machine," issued Apr. 25, 1978, teach the use of air jets to remove a web from the Fourdrinier when the normal transfer system fails (e.g., after a web break, or during start-up). Using air knives or vacuum boxes to assist transfer between fabrics (including press felts) is well known, and some small degree of differential velocity is probably common in such processes even when no velocity differential is desired. Positive draws, in which the sheet is stretched slightly, are most common, but it is conceivable that negative draws (resulting in rush transfer) have occurred regularly in commercial operation of conventional sheet transfers. The degree of rush transfer in such cases is likely on the order of 5% or less.

In spite of the gains made by Engel et al., rush transfer in their process still occurs over a finite span of simultaneous contact between two differentially moving wires. Hence there is a need for a rush transfer method that provides better control of the geometry of the contact region and permits control of the force of contact between the fabrics, thereby producing improved internal bulk without macrofolds.

SUMMARY OF THE INVENTION

In general, the invention is a modified rush transfer process for use in known wet-laid papermaking processes in which the contact between the carrier fabric and the transfer fabric at the rush transfer zone is defined by a shoe, roll, or other convex support underneath the carrier fabric coupled with an opposing vacuum transfer shoe, which is preferably convex, either curved or angled, in contact with the transfer fabric. This method enables greater angles of convergence and divergence between the two fabrics to be achieved, possibly reducing the length of the contact zone between the two fabrics to an arbitrarily small distance or eliminating it altogether, optionally with the assistance of an air knife or jet in a carrier fabric support shoe. Reduction of the contact region between the two fabrics helps reduce the danger of macrofolds and other forms of sheet damage, especially at high levels of rush transfer. The reduced contact zone also allows the transfer fabric to have arbitrary texture without risk of damage to the web by excessive friction from the raised elements of the transfer fabric.

Hence in one aspect, the invention resides in a method for transferring a web supported by a carrier fabric to a slower-moving transfer fabric wherein the transfer fabric and the carrier fabric converge and diverge as the transfer fabric passes over a vacuum shoe having a vacuum slot and the carrier fabric passes over a deflection element, wherein the vacuum shoe deflects the transfer fabric towards the carrier fabric and the deflection element deflects the carrier fabric towards the vacuum shoe such that the web transfers to the transfer fabric as the web passes over the vacuum slot.

In some embodiments, it is possible that a small but finite gap can be maintained between the fabrics, although shear forces at a contact point may be desirable in many cases for internal debonding of the web. Also, the method of this invention can provide additional pressure driving forces for sheet transfer beyond the inherently limited range of vacuum pressure by providing a lower support shoe under the carrier fabric which not only controls transfer region geometry, but also provides an air jet or air jets for lifting the sheet off the carrier fabric, decelerating the sheet as desired, and placing it in contact with the transfer fabric. In addition, the method of this invention can provide means for improved control over the geometry and physical operation of the transfer region such that adjustments and modifications can be made easily while the paper machine continues to operate. Such modifications include changing the contacting force of the carrier fabric support shoe or roll, controlling the force profile in the cross machine direction, controlling the axial and transverse location of the support shoe as well as possible tilt of the shoe; controlling the air flow rate when nozzles are used in the carrier fabric support shoe; and controlling the position of the transfer head as well as the vacuum level in said transfer head.

In preferred embodiments, the effective angles of convergence and divergence of the two wires can be about 5 degrees or more, preferably about 10 degrees or more, more preferably 20 degrees or more, still more preferably 30 degrees or more, and most preferably 45 degrees or more, with another preferable embodiment comprising the range of 40 to 80 degrees. The angle of divergence is believed to be more critical for success of the invention, so the angle of convergence may be significantly lower than the angle of divergence while still falling within the scope of the present invention. Angles between the fabrics are defined by the angle between tangents to the wires at a distance of 2 inches upstream of the leading edge of the vacuum slot or vacuum openings in the transfer head for the convergence angle, and at a distance of 2 inches downstream of the trailing edge of the vacuum slot or vacuum openings in the transfer head for the divergence angle. An alternative definition of angle, termed "alternative convergence angle" and "alternative divergence angle," respectively, is identical to the previous definition but at distances of 4 inches rather than two inches from the ends of the vacuum slot or region of vacuum openings.

DETAILED DESCRIPTION OF THE DRAWING

Figure 1A:
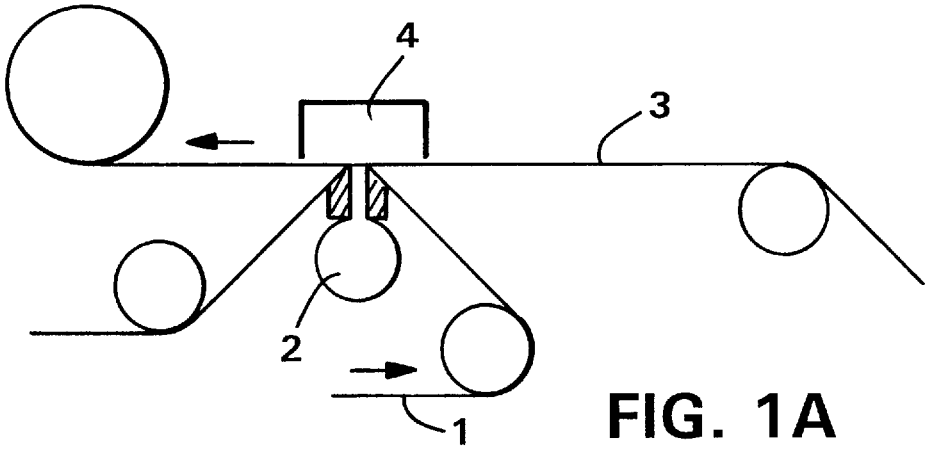
FIG. 1A (PRIOR ART)
FIGS. 1A and 1B illustrate rush transfer systems of the prior art.

Referring to FIG. 1A, schematically shown is a prior art rush transfer system as taught by U.S. Pat. No. 4,072,557 to Schiel, previously discussed. Shown is the carrier fabric 1, a pressurized transfer head 2, a transfer fabric 3 and a suction box 4.

Figure 1B:
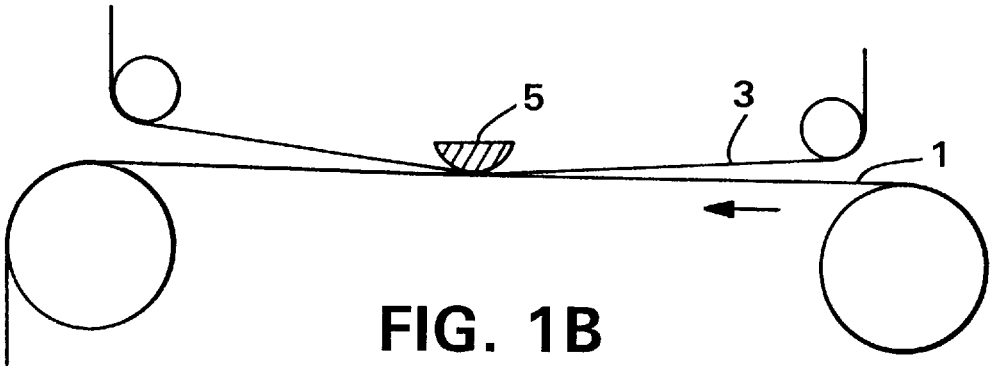
FIG. 1B (PRIOR ART)

FIG. 1B also schematically illustrates a prior art rush transfer process as taught by U.S. Pat. No. 4,440,597 to Wells et al. Shown is a vacuum pick-up shoe 5 which deflects the transfer fabric 3 and the carrier fabric 1 in the transfer zone.

Figure 2:
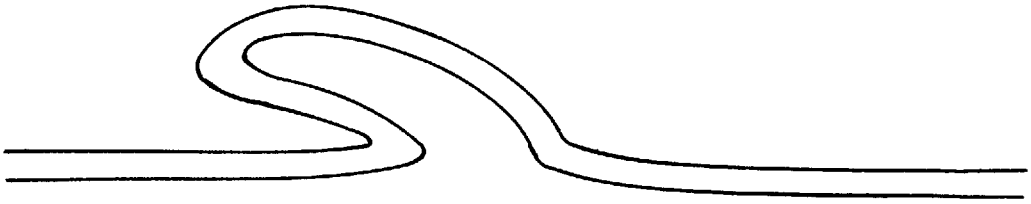
FIG. 2 is a schematic representation of a "macrofold" in a web.

FIG. 2 is a simple schematic illustration of a "macrofold", in which certain regions of the web are folded over onto the web.

Figure 3:
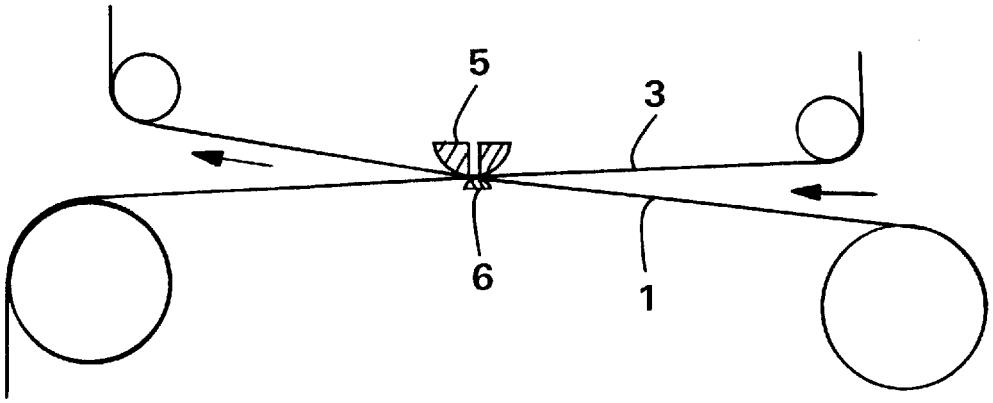
FIG. 3 is a schematic representation of a rush transfer method in accordance with this invention.

FIG. 3 is a schematic illustration of a rush transfer process in accordance with this invention. Shown is the carrier fabric 1 and the transfer fabric 3 converging and diverging in the transfer zone. The carrier fabric is deflected out of its plane toward the transfer fabric by deflection element 6. The transfer fabric is deflected out of its plane between surrounding rolls toward the carrier fabric by the vacuum pick-up shoe 5. Rather than contact being achieved by impingement of the transfer shoe into the plane of the carrier fabric, the opposite is achieved as the carrier fabric is urged towards the transfer head.

Figure 4:
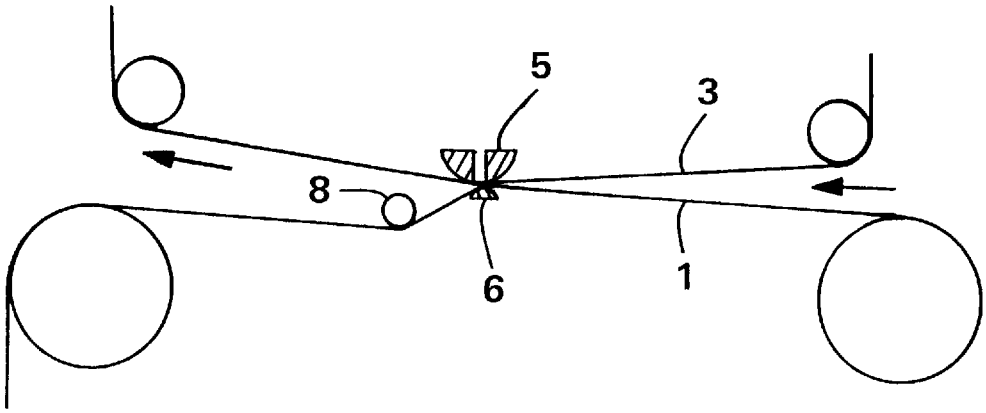
FIG. 4 is a schematic representation of an alternative method in accordance with this invention.

FIG. 4 is a schematic illustration of an alternative embodiment of this invention, wherein the angle of divergence between the carrier fabric and the transfer fabric is further increased by the presence of a second deflection element 8 downstream of the transfer point such that the bare carrier fabric (no longer carrying a web) is deflected away from the transfer fabric. Such a deflection roll could also be placed upstream of the transfer point to increase the angle of convergence, but the roll would have to contact the wet paper web and may cause undesired compression of the web. To deflect the carrier fabric away from the transfer fabric without mechanically compressing the paper web, a vacuum box may be desirable to provide a downward force on the carrier fabric and paper web ahead of the transfer zone. The vacuum box may be coupled with a steam box on the paper web side of the carrier fabric to preheat the web and improve water removal and possibly improve the properties of the web for the rush transfer stage. Deflection of the carrier fabric upstream of the transfer zone and further dewatering may also be achieved by use of air jets or an air press, wherein air, including heated air, is impinged against the wet web, possibly with vacuum suction below.

The present invention differs over both Schiel and Wells and Hensler in providing two deflection elements, one behind each wire approaching the transfer zone, to control the angles of convergence and divergence and to minimize the length of the contact zone, in contrast to related art methods in which the wire deflected by a transfer shoe impinges into the plane of the opposing wire. The present invention is further distinguished over prior art in providing for the possibility of a finite gap between the wires across which rush transfer of the web takes place without contact between the two wires. Achieving the latter embodiment will require use of a narrow air knife rather than mere differential pressure over a broad area, with the narrow air jet properly directed to lift and decelerate the web and press it against the slower moving transfer fabric.

Figure 5:
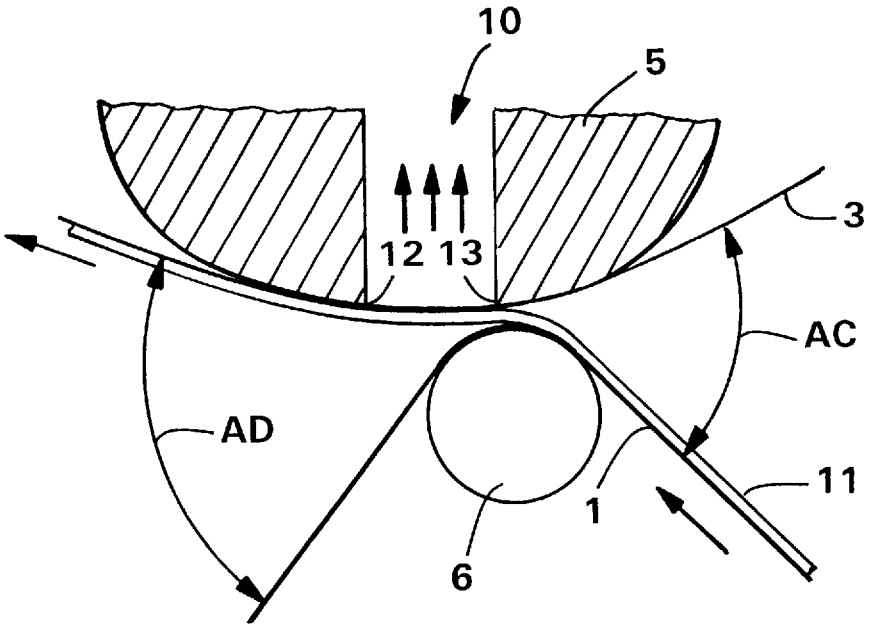
FIG. 5 is a more detailed schematic illustration of the transfer zone in the method of this invention.

Details of the transfer zone in one embodiment of this invention are shown in FIG. 5. Shown is the vacuum slot 10 within the vacuum pick-up shoe 5, the web 11 being transfer from the carrier fabric 1 to the transfer fabric 3, the deflection element 6, the angle of divergence "AD" and the angle of convergence "AC." The carrier fabric deflection element urges the fabric and the web into the transfer zone. FIG. 5 shows the transfer zone established on the leading edge 12 of the vacuum transfer slot, which is a preferred embodiment, but it is recognized that the relative positions of the carrier fabric deflection element and the transfer shoe may be adjusted to establish a transfer zone at alternate locations relative to the vacuum transfer shoe, including on the trailing edge 13 of the vacuum transfer slot. Transfer is assisted by suction through a vacuum slot or other openings in the transfer shoe or in a suction roll (not shown). Preferably, a transfer shoe is used as is taught by Engel et al. Other possible vacuum shoe designs include that of Wells and Hensler as well as Grobe et al. The carrier fabric deflection element can be either a stationary shoe or a moving element such as a small radius roll. To help maintain a small contact point, the effective radius of curvature of the deflection element should be small, and in particular should be less than about 14 inches, preferably less than about 8 inches, preferably less than about 5 inches, more preferably less than 3 inches, still more preferably less than 2 inches, with especially preferred values being between 0.2 and 2 inches and particularly between about 0.4 and 1.5 inches. Deformable elements should be included in the shoes or rolls used, or in their respective support means, in order to help maintain a constant gap or constant compressive load between the two elements. The vacuum slot should be narrow, preferably less than 3 inches, more preferably less than 1.5 inches, more preferably less than 1 inch, and more preferably still less than 0.5 inch.

Since separation of a carrier fabric from a solid surface can induce vacuum forces at the separation point, which could oppose the transfer of the fabric, it is preferred that the carrier fabric deflection element be equipped with means for breaking the seal between the carrier fabric and the deflection element. Such means for either a stationary or rotating deflection element can include grooves, blind holes, channels, or slots on the surface of the element to provide access for air flow from the surrounding atmosphere toward the separation point. Other means for breaking the seal between the carrier fabric and the deflection element include use of a porous surface such as sintered metal or porous ceramic. Alternatively, the element can be internally equipped with means to conduct air or steam supplied from within the element itself toward the outer surface in order to prevent a vacuum seal. Such means includes channels, slots, or other openings for conducting pressurized air to the separation region on the outer surface, or an integrally porous construction, at least in part, for allowing air to reach a narrow or broad zone on the exterior of the deflection element. In one embodiment, an air or steam jet passes through the deflection element and not only serves to break the vacuum, but provides pressure force for moving the web to the transfer fabric and may, if properly directed with a finite velocity component opposing the direction of the carrier fabric, provide deceleratory force to help cause foreshortening of the web as it is transferred. For effective transfer using an air knife or similar pneumatic system, the air knife preferably should have a narrow opening extending across the breadth of the web, said opening being less than 2 mm, preferably less than 1 mm, and most preferably less than 0.5 mm in width, where the width is defined as the gap between the opposing surfaces of the air knife nozzle at the exit. For effective air velocities, the stagnation pressure within the air knife (i.e., in the plenum of the air knife or in the pneumatic pressure source coupled to the air knife orifice) should be greater than 1 psig (gauge pressure), preferably greater than 3 psig, more preferably greater than 10 psig, more preferably still greater than 20 psig, and most preferably greater than 50 psig, with a range of 5 to 50 psig believed to be suitable for many conditions.

Figure 6:
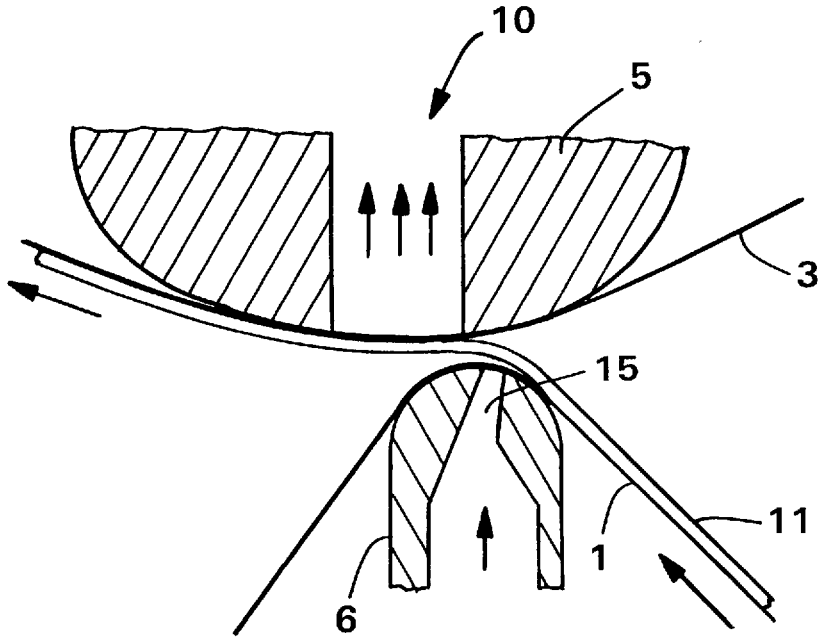
FIG. 6 is a schematic illustration similar to FIG. 5, but depicting a stationary deflection element with an interior air jet.

FIG. 6 shows one embodiment wherein an air jet is used to assist the transfer of the web from the carrier fabric to the transfer fabric. A deflection element (in this case a stationary shoe) is depicted inside of which an air nozzle 15 is integrally formed. Alternatively, the air nozzle could be a separate device which is suitably disposed to provide air flow through an opening in the carrier fabric deflection element. It is believed that a narrow air jet, typified by an air knife, may be most effective in rush transfer because the air jet can provide a focused force to decelerate the paper web over a narrow zone and rapidly move it across a narrow gap, if desired. An air knife may also be useful in further dewatering of the wet web. If a gap is established, the sheet can be transferred without mechanical compression and friction between the two webs.

Several strategies can be pursued to help maintain a relatively uniform gap between the vacuum pickup shoe and the carrier fabric deflection element along the entire cross-direction width of a paper machine. Either the deflection element of the vacuum pickup shoe can be broken up into separately supported or separately positionable units across the CD span, preferably with pneumatic or hydraulic adjustment of position or load being possible. Alternatively, the elements could be spring loaded or pneumatically or hydraulically loaded to maintain a constant supporting force, allowing the elements to "give" should the opposing object (the transfer shoe for a unit of the carrier fabric deflection element or the deflection element for a unit of the transfer shoe) be too close and exert excessive force on the paper web. The leading edge of the transfer shoe may desirably have a flexible polymeric or fluid-filled chamber which supports the low-friction solid outer surface in such a manner that the chamber or support base can give in response to loading, helping to maintain more uniform loading across the width of the element.

The rush transfer operation of the present invention can be used in any known wet-laid papermaking process. The formation of the paper sheet can be achieved through a variety of formers, such as twin-wire formers, breast roll formers, gap formers, crescent formers, and the like. The embryonic web may be formed on traditional forming fabrics or on more textured or three-dimensional fabrics. The use of textured forming fabrics is taught by M. K. Ramasubramanian and C. A. Lee in U.S. Pat. No. 5,098,519, "Method for Producing a High Bulk Paper Web and Product Obtained Thereby," issued Mar. 24, 1992 and hereby incorporated by reference, and by G. A. Wendt et al. in U.S. Pat. No. 4,942,077, "Tissue Webs Having a Regular Pattern of Densified Areas," issued Jul. 17, 1990, also hereby incorporated by reference. Elimination of a forming fabric altogether with formation directly on a through drying fabric is taught by Wendell J. Morton, "Process and Apparatus for Forming a Paper Web Having Improved Bulk and Absorptive Capacity," in U.S. Pat. No. 4,102,737 issued May 16, 1977, herein incorporated by reference.

The web can be made with any suitable papermaking fibers, including fibers derived from wood, cotton, flax hemp, bagasse, kenaf, and other natural materials, as well as mixtures of natural and synthetic fibers in an aqueous slurry. Papermaking slurries can include various chemicals and particulates as is known in the art, including temporary and permanent wet strength resins; dry strength additives such as starches and cationic charged polymers; reactive dye components; polymeric retention aids, including bicomponent systems and systems involving silica, clays, and the like; mineral and organic fillers; opacifiers, including waxes and microspheres; softeners and debonders; and the like. Fibers may have been subjected to any number of mechanical, chemical, and thermal processing steps, including mechanical refining, chemical crosslinking, steam explosion, mechanical dispersing or kneading; oxidation or sulfonation; exposure to elevated temperature, etc.

After forming and prior to rush transfer, the web is preferably from about 19% to about 30% cellulosic fiber by weight, and more preferably from about 19% to 27% cellulosic fiber by weight.

Suitable carrier fabrics can be typical papermaking forming fabrics including, for example, Albany 84M and 94M, available from Albany International of Albany, N.Y.; Asten 856, 866, 892, 959, 937 and Asten Synweve Design 274, available from Asten Forming Fabrics, Inc. of Appleton, Wis. The carrier fabric can be a woven fabric, a punched film or sheet, a molded belt, or a fabric as taught in U.S. Pat. No. 4,529,480 to Trokhan. Forming fabrics or felts comprising nonwoven base layers may also be useful, including those of Scapa Corporation made with extruded polyurethane foam such as the Spectra Series. Relatively smooth forming fabrics can be used, as well as textured fabrics suitable for imparting texture and basis weight variations to the web.

Suitable transfer fabrics may include fabrics that are also suitable for carrier fabrics, such as those mentioned above, and Asten 934 and 939, or Lindsay 952-S05 and 2164 fabric from Appleton Mills, Appleton, Wis. Additionally, novel three-dimensional fabrics comprising deformable nonwoven upper layers may be suitable, as disclosed in commonly-owned co-pending application of Lindsay et al, Ser. No. 08/709,427, filed Sep. 6, 1996, and entitled, "Process for Producing High-Bulk Tissue Webs Using Nonwoven Substrates". Rush transfer may also be done onto a throughdrying fabric as the transfer fabric. Suitable throughdrying fabrics include, without limitation, Asten 52B, 803, 920A and 937A, and Velostar P800, 800 and 103A, also made by Asten, as well as Albany 5602 and Lindsay T116 style fabrics and other Lindsay throughdrying fabrics. Fabrics described in U.S. Pat. No. 5,429,686 issued Jul. 4, 1995 to K. F. Chiu et al. may also be suitable. In general, transfer fabrics may be relatively smooth, like typical forming fabrics, to maximize foreshortening and bulking of the sheet, or they may be textured, like the Lindsay throughdrying fabrics mentioned above, to provide texture and three-dimensional structure to the sheet.

The speed differential between the carrier fabric and the transfer fabrics can be greater than 5%, preferably greater than 10%, more preferably greater than 25%, and most preferably greater than 40%, desirably in the range of 10 to 60%.

Following the rush transfer operation, the web is preferably dried with noncompressive drying means. "Noncompressive drying" refers to drying methods such as through-air drying; air jet impingement drying; non-contacting drying such as air flotation drying; through-flow or impingement of superheated steam; microwave drying and other radio frequency or dielectric drying methods; water extraction by supercritical fluids; water extraction by nonaqueous, low surface tension fluids; infrared drying; drying by contact with a film of molten metal; and other methods for drying cellulosic webs that do not involve compressive nips or other steps causing significant densification or compression of a portion of the web during the drying process.

The ability to properly execute rush transfer to provide high internal void volume in the sheet makes the present invention especially useful in the production of high bulk materials. High bulk is augmented greatly by the use of wet molding of a sheet to create a three-dimensional structure after the rush transfer process. Through drying on a three-dimensional, highly textured fabric is an especially preferred method for achieving high bulk. In addition, special fibers or specially treated fibers may be used to achieve improved absorbency, bulk, or softness. A low-density three-dimensional structure can be achieved in part by combining rush transfer, as taught herein, with a variety of means, including but not limited to the use of specially treated high-bulk fibers such as curled or chemically treated fibers as an additive in the furnish, including the fibers taught by C. C. Van Haaften in "Sanitary Napkin with Cross-linked Cellulosic Layer," U.S. Pat. No. 3,339,550, issued Sep. 5, 1967, which is hereby incorporated by reference; mechanical straining or "wet straining" of the moist web, including the methods taught by M. A. Hermans et al. in U.S. Pat. No. 5,492,598, "Method for Increasing the Internal Bulk of Throughdried Tissue," issued Feb. 20, 1996, herein incorporated by reference, and M. A. Hermans et al. in U.S. Pat. No. 5,411,636, "Method for Increasing the Internal Bulk of Wet-Pressed Tissue," issued May 2, 1995, herein incorporated by reference; molding of the fiber onto a three-dimensional wire or fabric, such as the fabrics disclosed by Chiu et al. in U.S. Pat. No. US 5,429,686, "Apparatus for Making Soft Tissue Products," issued Jul. 4, 1995, which is hereby incorporated by reference, including differential velocity transfer onto or from said three-dimensional wire or fabric; wet embossing of the sheet; wet creping; and the optional use of chemical debonding agents.

The present invention is expected to increase the range of process variables over which rush transfer can be achieved successfully. In particular, the elimination of broad contact regions between the two wires is expected to reduce the incidence of macrofolds and to allow bulkier sheet with higher MD stretch to be achieved. Improved absorbent properties may be possible with noncontacting or low-contact area embodiments of the present invention, for higher internal bulk should be possible.

It will be appreciated that the foregoing description, given for purposes of illustration, is not to be construed as limiting the scope of the invention, which is defined by the following claims and all equivalents thereto.

We claim:

1. A method for transferring a cellulosic web supported by a carrier fabric to a slower-moving transfer fabric wherein the transfer fabric and the carrier fabric converge and diverge as the transfer fabric passes over a vacuum shoe having a vacuum slot and the carrier fabric passes over a deflection element, wherein the vacuum shoe deflects the transfer fabric towards the carrier fabric and the deflection element deflects the carrier fabric towards the vacuum shoe such that the web transfers to the transfer fabric as the web passes over the vacuum slot.

2. The method of claim 1 wherein the deflection element has a radius of curvature of about 14 inches or less.

3. The method of claim 1 wherein the deflection element has a radius of curvature of about 5 inches or less.

4. The method of claim 1 wherein the deflection element has a radius of curvature of from about 0.2 to about 2 inches.

5. The method of claim 1 wherein the angle of divergence between the carrier fabric and the transfer fabric is about 5 degrees or greater.

6. The method of claim 1 wherein the angle of divergence between the carrier fabric and the transfer fabric is about 10 degrees or greater.

7. The method of claim 1 wherein the angle of divergence between the carrier fabric and the transfer fabric is about 20 degrees or greater.

8. The method of claim 1 wherein the angle of divergence between the carrier fabric and the transfer fabric is about 30 degrees or greater.

9. The method of claim 1 wherein the angle of divergence between the carrier fabric and the transfer fabric is about 45 degrees or greater.

10. The method of claim 1 wherein the angle of divergence between the carrier fabric and the transfer fabric is from about 40 to about 80 degrees.

11. The method of claim 1 wherein the angle of divergence between the carrier fabric and the transfer fabric is greater than the angle of convergence between the carrier fabric and the transfer fabric.

12. The method of claim 1 wherein the deflection element is a roll.

13. The method of claim 1 wherein the deflection element contains an orifice through which pressurized air is directed at the web to assist transfer of the web to the transfer fabric.

14. The method of claim 1, wherein the deflection element is provided with a means for breaking or preventing the formation of a vacuum seal between the carrier fabric and the deflection element.

15. The method of claim 1, wherein the vacuum shoe is convex, having a radius of curvature of about 12 inches or less.

16. The method of claim 1, wherein the vacuum shoe is convex, having a radius of curvature of about 5 inches or less.

17. The method of claim 1, wherein the ratio of the radius of curvature of the vacuum shoe to the radius of curvature of the deflection element is in the range of 0.5 to 2.0.

18. The method of claim 1, wherein the vacuum shoe is concave adjacent the vacuum slot.

19. The method of claim 1, wherein the carrier fabric and transfer fabric are relatively smooth compared to three-dimensional through-drying fabrics, such that the carrier fabric and transfer fabric have smoothness characteristic of forming fabrics.

20. The method of claim 1, wherein the transfer fabric is moving at least 10% more slowly than the carrier fabric.

21. The method of claim 1, wherein the transfer fabric is moving at least 25% more slowly than the carrier fabric.

22. The method of claim 1, wherein the deflection element is stationary.

23. A method for transferring a cellulosic web supported by a carrier fabric to a slower-moving transfer fabric wherein the transfer fabric and the carrier fabric converge and diverge as the transfer fabric passes over a shoe having an opening therein and the carrier fabric passes over a deflection element having at least one orifice therein for discharging pressurized gas, said orifice communicating pneumatically with a pressurized gas source, wherein the shoe deflects the transfer fabric toward the carrier fabric and the deflection element deflects the carrier fabric toward the shoe, and gas discharging from said orifice acts to assist the transfer of the web to the transfer fabric.

24. The method of claim 23, wherein said orifice is an air jet nozzle having a nozzle opening of less than about 1 mm directly coupled to a pressurized gas source having a stagnation pressure greater than 10 psig.

25. The method of claim 23 wherein a gap exists between said carrier fabric and said transfer fabric such that both fabrics cannot simultaneously engage the web.

26. The method of claim 23, wherein the speed differential between the carrier fabric and the transfer fabric is greater than 10%.

27. The method of claim 1 or 23, wherein said web prior to transfer to the transfer fabric has from about 19% to about 30% fibers by weight.

28. The method of claim 1 or 23, wherein said web prior to transfer to the transfer fabric has from about 19% to about 27% fibers by weight.

29. The method of claim 1 or 23, wherein said web is microcompacted to have increased bulk at a microscopic level by the transfer.

30. The method of claim 1 or 23, wherein the transfer fabric is a textured throughdrying fabric.

* * * * *